US012507798B2

(12) United States Patent
Zucca et al.

(10) Patent No.: US 12,507,798 B2
(45) Date of Patent: Dec. 30, 2025

(54) MULTI-CONFIGURABLE COUNTERTOP

(71) Applicant: Home Depot Product Authority, LLC, Atlanta, GA (US)

(72) Inventors: Michele Zucca, Gallo di Petriano (IT); Benjamin Ward, White, GA (US); Michael Chung, Ajax (CA); Emily Knight, Brookhaven, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 168 days.

(21) Appl. No.: 18/104,657

(22) Filed: Feb. 1, 2023

(65) Prior Publication Data

US 2024/0251944 A1 Aug. 1, 2024

(51) Int. Cl.

| | |
|---|---|
| ***A47B 77/02*** | (2006.01) |
| ***A47B 13/08*** | (2006.01) |
| ***A47B 96/20*** | (2006.01) |

(52) U.S. Cl.

CPC ..... *A47B 77/022* (2013.01); *A47B 96/201* (2013.01); *A47B 13/088* (2013.01); *A47B 2077/025* (2013.01)

(58) Field of Classification Search

CPC ..... A47B 77/022; A47B 13/088; A47B 13/08; A47B 87/002; A47B 1/04; A47B 2077/025; A47B 3/06; A47B 96/18; A47B 96/201; A47B 96/206; A47B 96/205; A47B 2230/11; A47B 2230/12; A47B 3/12; A47B 2200/001

See application file for complete search history.

(56) References Cited

U.S. PATENT DOCUMENTS

| | | | | |
|---|---|---|---|---|
| 4,158,335 A * | 6/1979 | Belcastro | A47B 87/002 | 403/292 |
| 4,646,654 A * | 3/1987 | Sullivan | A47B 1/04 | 108/69 |
| 4,976,565 A * | 12/1990 | Stefan | A47B 87/00 | 403/402 |
| 5,341,749 A * | 8/1994 | Noakes | A47B 87/002 | 248/188.8 |
| 5,485,795 A * | 1/1996 | Williams | A47B 1/04 | 108/69 |
| 5,595,427 A * | 1/1997 | Peters | A47B 87/002 | 52/584.1 |

(Continued)

FOREIGN PATENT DOCUMENTS

| | | | |
|---|---|---|---|
| DE | 4133520 A1 * | 4/1993 | A47B 87/002 |
| DE | 4215695 A1 * | 11/1993 | A47B 87/002 |

(Continued)

OTHER PUBLICATIONS

FR2961673 translation (Year: 2011).*

International Search Report and Written Opinion from application No. PCT/US2023/061865, dated Jul. 12, 2023, 9 pp.

*Primary Examiner* — Hiwot E Tefera

(74) *Attorney, Agent, or Firm* — Greenberg Traurig, LLP

(57) ABSTRACT

A countertop system includes a first slab having a first lateral slot that is laterally obscured by a first cover, and a second slab having a second lateral slot that is laterally obscured by a second cover. The first and second covers are configured to be removed with an application of pressure, and the first slot aligns with the second slot to receive a connector to couple the first slab to the second slab.

9 Claims, 7 Drawing Sheets

(56) References Cited

U.S. PATENT DOCUMENTS

| | | | | |
|---|---|---|---|---|
| 6,135,581 | A * | 10/2000 | Kopp | A47B 77/022 4/631 |
| 11,246,416 | B2 | 2/2022 | Harris | |
| 2002/0166482 | A1* | 11/2002 | Goldberg | A47B 87/002 108/65 |
| 2005/0045073 | A1* | 3/2005 | Wasley | A47B 87/002 108/65 |
| 2005/0247241 | A1* | 11/2005 | Sherman | A47B 13/088 108/64 |
| 2007/0204772 | A1* | 9/2007 | Evans | A47B 1/04 108/166 |
| 2012/0103235 | A1* | 5/2012 | Summerville | A47B 1/03 108/89 |
| 2017/0306996 | A1* | 10/2017 | Scapin | A47B 96/18 |
| 2019/0069668 | A1 | 3/2019 | Cameron | |
| 2019/0125070 | A1 | 5/2019 | Summerville | |
| 2021/0085081 | A1* | 3/2021 | Harris | B32B 3/06 |
| 2021/0215181 | A1* | 7/2021 | Maager | A47B 47/042 |

FOREIGN PATENT DOCUMENTS

| | | | | |
|---|---|---|---|---|
| EP | 2245961 | A1 | 11/2010 | |
| FR | 2961673 | A1 * | 12/2011 | A47B 1/04 |
| WO | WO-2009059821 | A1 * | 5/2009 | F16B 5/0092 |
| WO | WO-2009077130 | A1 * | 6/2009 | A47B 87/002 |

* cited by examiner

MULTI-CONFIGURABLE COUNTERTOP

TECHNICAL FIELD

This disclosure generally relates to countertop slabs that can be arranged in multiple configurations.

BACKGROUND

Countertops can come in a wide range of shapes and sizes based on the particular needs of a user and dimensions of the user's kitchen. As such, countertops are often made-to-order, or are amalgamations of slabs of various sizes.

DETAILED DESCRIPTION

Traditionally, when installing a countertop, particularly laminate countertops, a property owner, contractor, etc., is generally limited to a certain number of pre-fabricated sizes and shapes, or might be forced to acquire a customized countertop, resulting in complication and delay in assembling and installing the countertop. For a manufacturer, this wide range of countertop sizes and shapes can lead to wasted inventory, or require specialized machines to customize countertops on-demand. In contrast to other home goods that may come in a standardized size or set of sizes (e.g., sinks, ranges, microwaves), countertops are unique in that almost every request for a countertop presents different constraints or requests. As such, it is desirable for a universal countertop slab or assembly that may be configurable into multiple arrangements to satisfy a wide range of desired sizing and shapes. Such a universal countertop slab or assembly may simplify manufacturing and assembly processes relative to known countertops.

Figure 1:
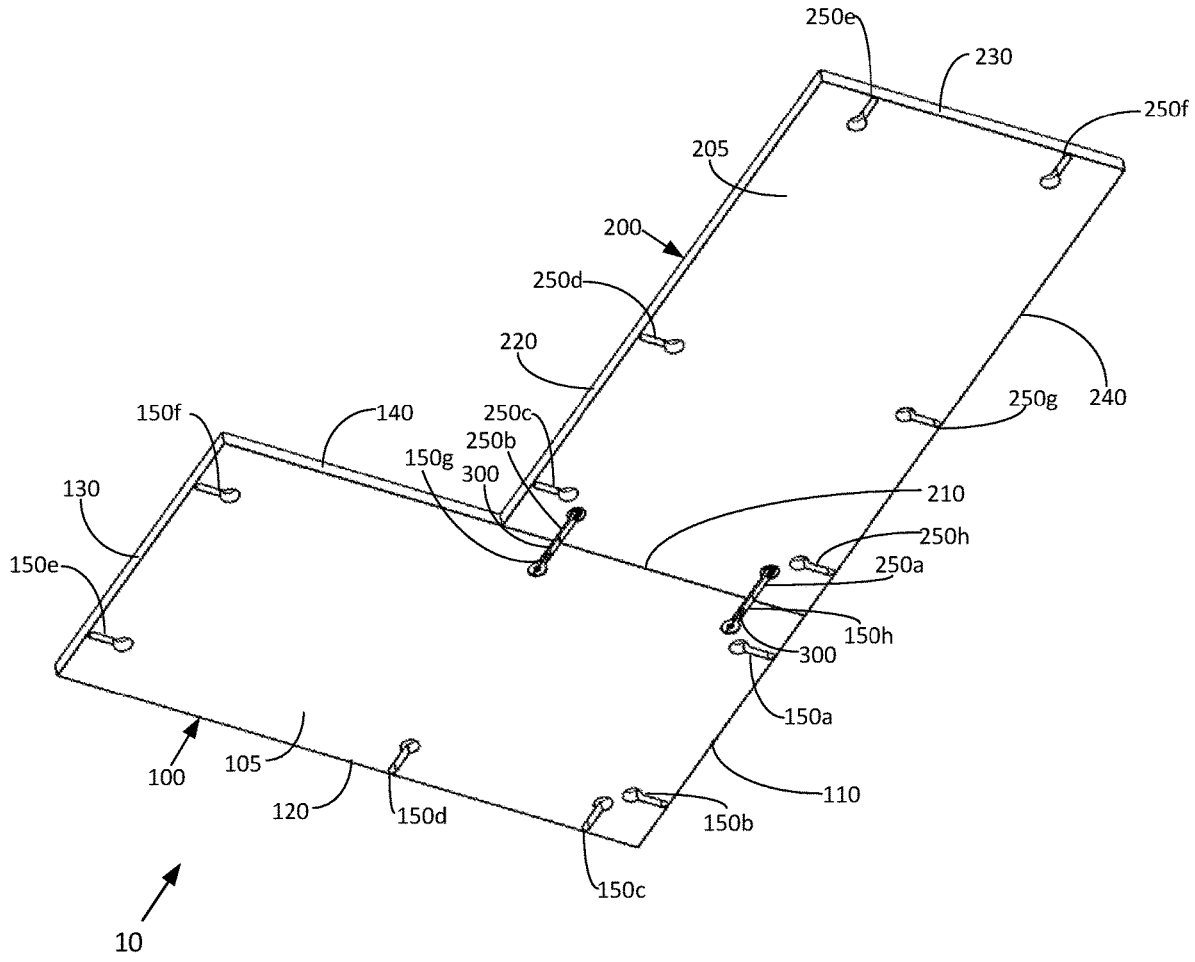
FIG. 1 is a bottom perspective view of an example assembly of two example countertop slabs.

Referring now to the drawings, wherein like numerals refer to the same or similar features in the various views, FIG. 1 is a bottom perspective view of an assembly 10. The assembly 10 may include a first slab 100 and a second slab 200. The first slab 100 may include a first body 105 that may be substantially rectangular, and may include a substrate covered by a laminate layer. The substrate may be or may include, for example, particle board, medium density fiberboard (MDF), plywood, or another suitable material. The laminate layer may be laminated to the substrate and may be or may include a plastic sheet or wood veneers, in some embodiments.

The first body 105 may further include a first side 110, a second side 120, a third side 130, and a fourth side 140 (collectively "first sides"). The first side 110 and the third side 130 may have a first length, and the second side 120 and the fourth side may have a second length that is longer than the first length. The first side 110 may form a right angle with the second side 120 on one end and with the fourth side 140 on the other end. The third side 130 may form a right angle with the fourth side 140 on one end and with the second side 120 on the other end.

The first body 105 may further include a plurality of slots 150. Each of the sides 110, 120, 130, 140 may include a pair of two slots 150. A distance between the slots 150 in a pair is the same for each of the sides 110, 120, 130, 140 (e.g., the gap between the pair of two slots 150 is the same on all four sides 110, 120, 130, 140 of the first slab 100). In particular, the first side 110 may include a first slot 150*a* and a second slot 150*b*, the second side 120 may include a third slot 150*c* and a fourth slot 150*d*, the third side 130 may include a fifth slot 150*e* and a sixth slot 150*f*, and the fourth side 140 may include a seventh slot 150*g* and an eighth slot 150*h*. Each slot 150 may include a passage perpendicular to its nearest side 110, 120, 130, 140 that culminates in a substantially circular cavity, in some embodiments. Additionally or alternatively, other sizes, shapes, and orientations of the slots 150 may be used and should be considered within the scope of this disclosure.

Figures 2A, 2B:
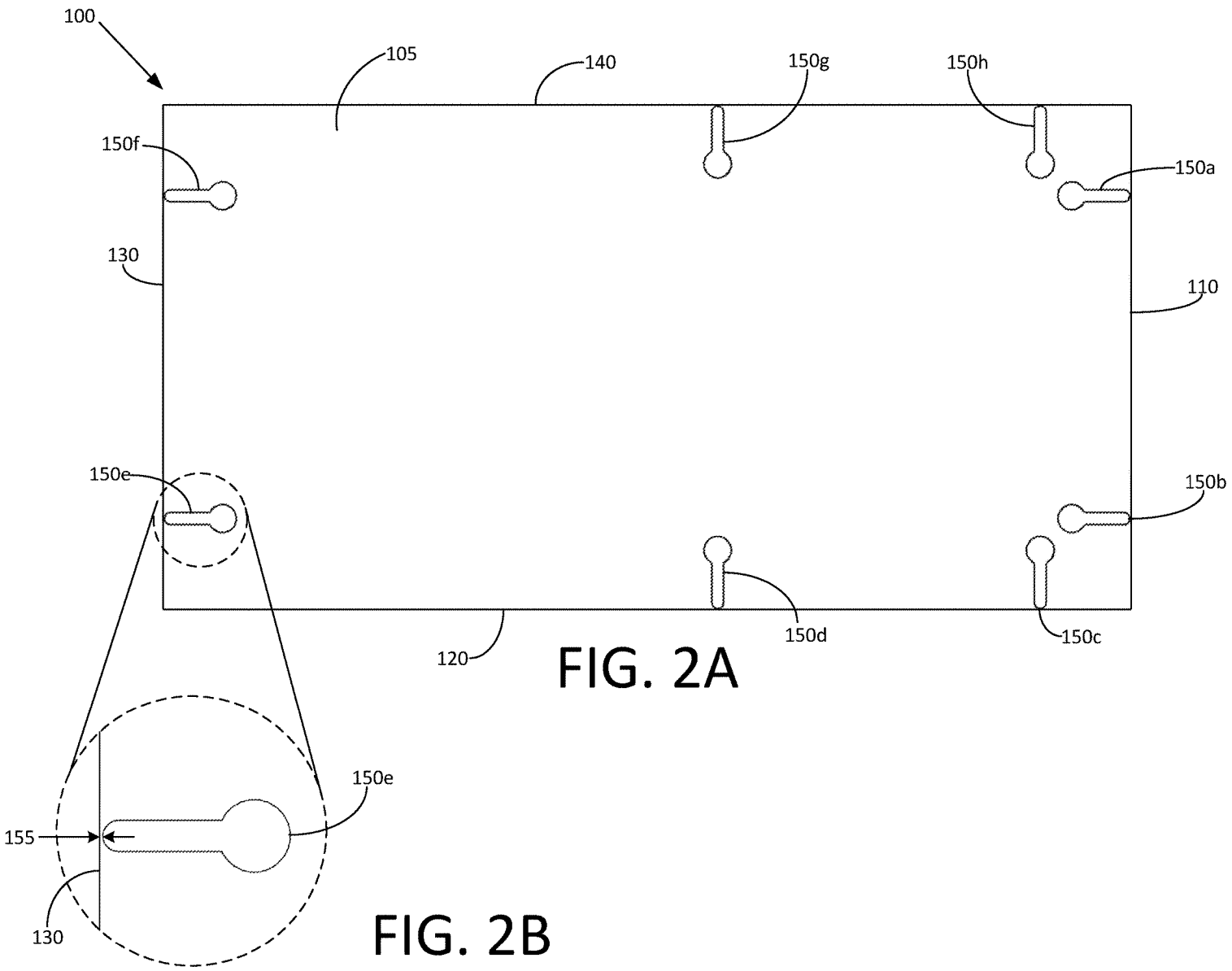
FIG. 2A is a bottom view of a countertop slab of the example assembly of FIG. 1.
FIG. 2B is an enlarged view of a slot of the example slab of FIG. 2A.

Referring to FIG. 2A, in some embodiments, slots 150*c* and 150*d* of the second side 120 and slots 150*g* and 150*h* of the fourth side 140 may be relatively closer to the first side 110 than to the third side 130. In some of these embodiments, the slot closest to the first side 110 (e.g., slots 150*c* and 150*h*) may be within 6 inches of the first side 110 (e.g., within 6 inches of the point at which the second side 120 or the fourth side 140 connects to the first side 110).

Figure 3:
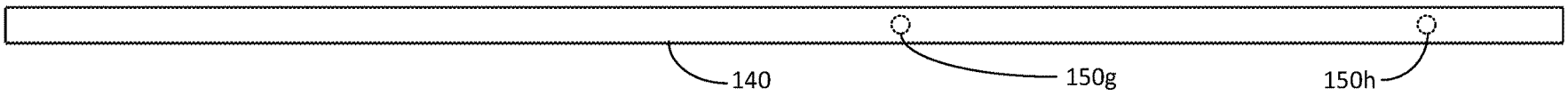
FIG. 3 is a side view of the countertop slab of FIG. 2A.
Figure 4:
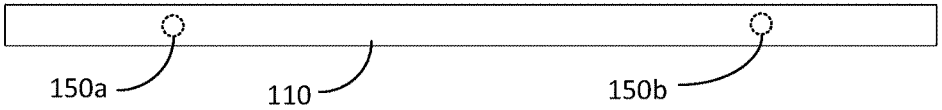
FIG. 4 is a front view of the countertop slab of FIG. 2A.
Figure 6:
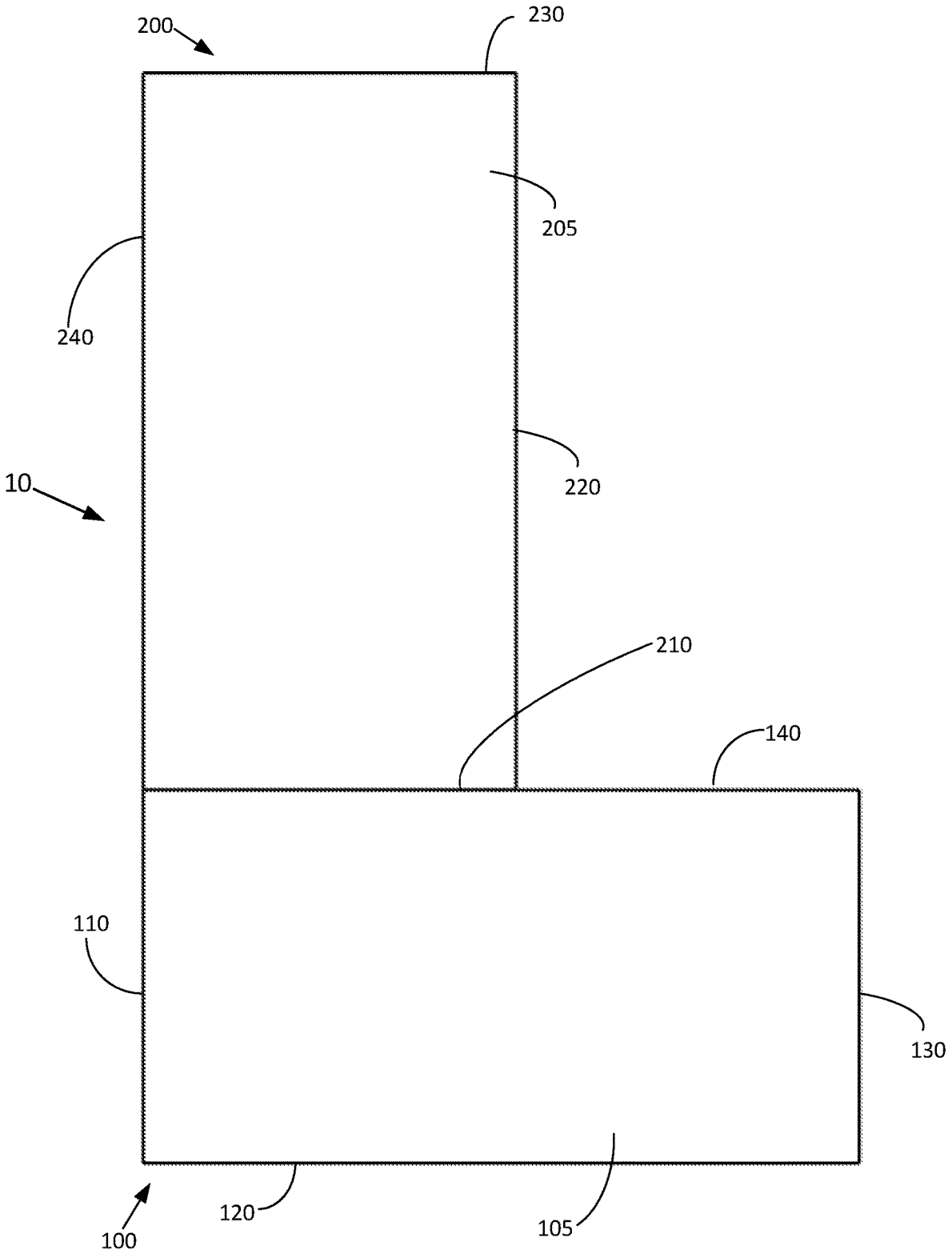
FIG. 6 is a top view of the assembly of FIG. 1.

Referring now to FIG. 2B, an enlarged view of the fifth slot 150*e* is shown. Although the fifth slot 150*e* is shown, the description herein may be applied to each of the slots 150. As shown in FIG. 2B, an amount of material, labelled as cover 155, of the first body 105 may remain between an external-most end of the slot 150*e* and an exterior surface of the third side 130. The cover 155 may be formed of both laminate and substrate, such that the substrate provides structure behind the laminate to form a sturdier cover 155 relative to a cover 155 that may be formed only of a laminate. In other embodiments, the cover 155 may be formed only of laminate, such that there is no substrate behind the cover 155. In further embodiments, the cover 155 may be formed of a polymer, such as acrylonitrile butadiene styrene (ABS) and polypropylene (PP). The cover 155 may be configured to be removed (e.g., punctured) via an application of force. Once the cover 155 is removed, the slot 150*e* may be exposed (e.g., an opening to the slot may be provided on the third side 130). However, prior to removal, the cover 155 may be monolithic with a surface of the third side 130, such that the cover 155 may laterally obscure (e.g., hide) the slot 150*e*. For example, referring now to FIGS. 3 and 4, slots 150*a*, 150*b*, 150*g*, and 150*h* are shown dashed circles because slots 150*a*, 150*b*, 150*g*, and 150*h* may not be visible until their respective covers 155 are removed, so the dashed circles are indicative of a silhouette of the slots 150*a*, 150*b*, 150*g*, and 150*h*. Furthermore, referring to FIG. 6, top external surfaces of the first body 105 and of the second body 205 are similarly monolithic and featureless.

Figure 5:
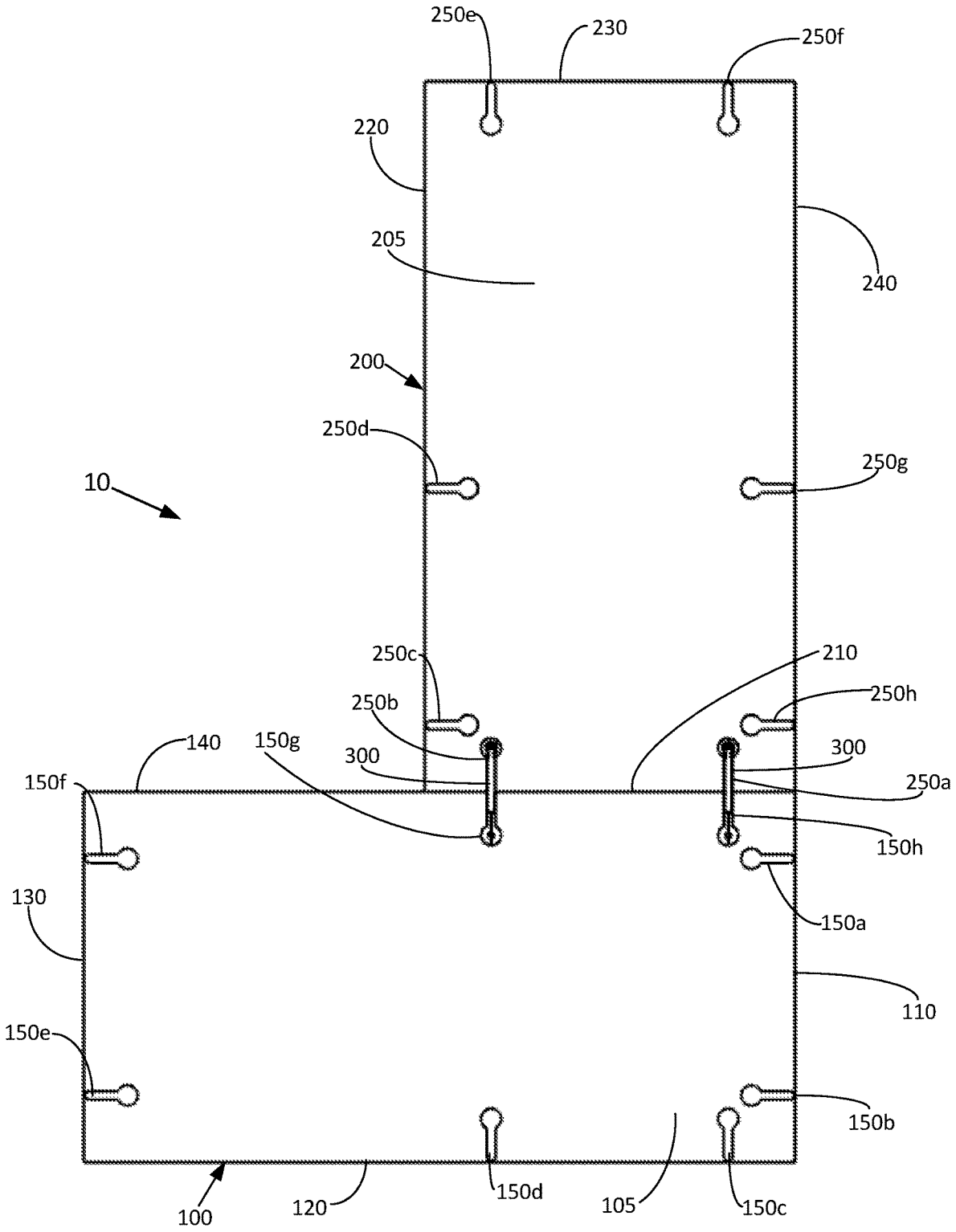
FIG. 5 is a bottom view of the assembly of FIG. 1.

Referring now to FIG. 5, in some embodiments, the second slab 200 may be identical to the first slab 100. As such, similarly numbered components may be equivalent (e.g., body 105 and 205, first side 110 and 210, first slot 150*a* and 250*a*, etc.) Because the distance between slots in a pair may be equivalent, any pair of slots 150 of the first slab 100 may align with any pair of slots 250 of the second slab 200.

Once the respective covers 155 are removed, a connector 300 may be inserted into the aligned slots to couple the first slab 100 to the second slab 200. The connector 300 may any suitable connector, such as a worktop bolt that tightens via an allen key, a nut-and-bolt combination, a miter draw bolt, etc.

Because a pair of slots 150 may align with any pair of slots 250, may different configurations for the assembly 10 are possible with only the two slabs 100, 200, or further configurations with a third slab, a fourth slab, etc. In the example shown in FIG. 5, the covers 155 are removed from slots 150*g*, 150*h*, 250*a*, and 250*b*, and a first connector 300 is inserted into slots 150*g* and 250*b* and a second connecter 300 is inserted into slots 150*h* and 250*a*, such that the assembly 10 is substantially J-shaped. In another example (not shown), slots 150*a* and 150*b* may be aligned with slots 250*b* and 250*a* respectively to configure the assembly 10 in a substantially rectangle-shaped configuration.

The slabs 100, 200 may advantageously be used to create many different countertop arrangements using one or more copies of an identical slab. For example, because the slots 150 of the slab 100 are covered, the slab 100 may be used alone as a finished countertop. In another example, two slabs 100, 200 may be used to form an L-shape countertop (as in FIGS. 5 and 6), with the two slabs oriented perpendicular to each other. In another example, two slabs 100, 200 may be placed end-to-end, parallel with each other, to form an extra-long countertop. Many other configurations are possible (including configurations with three, four, or more slabs) and contemplated.

Figure 7:
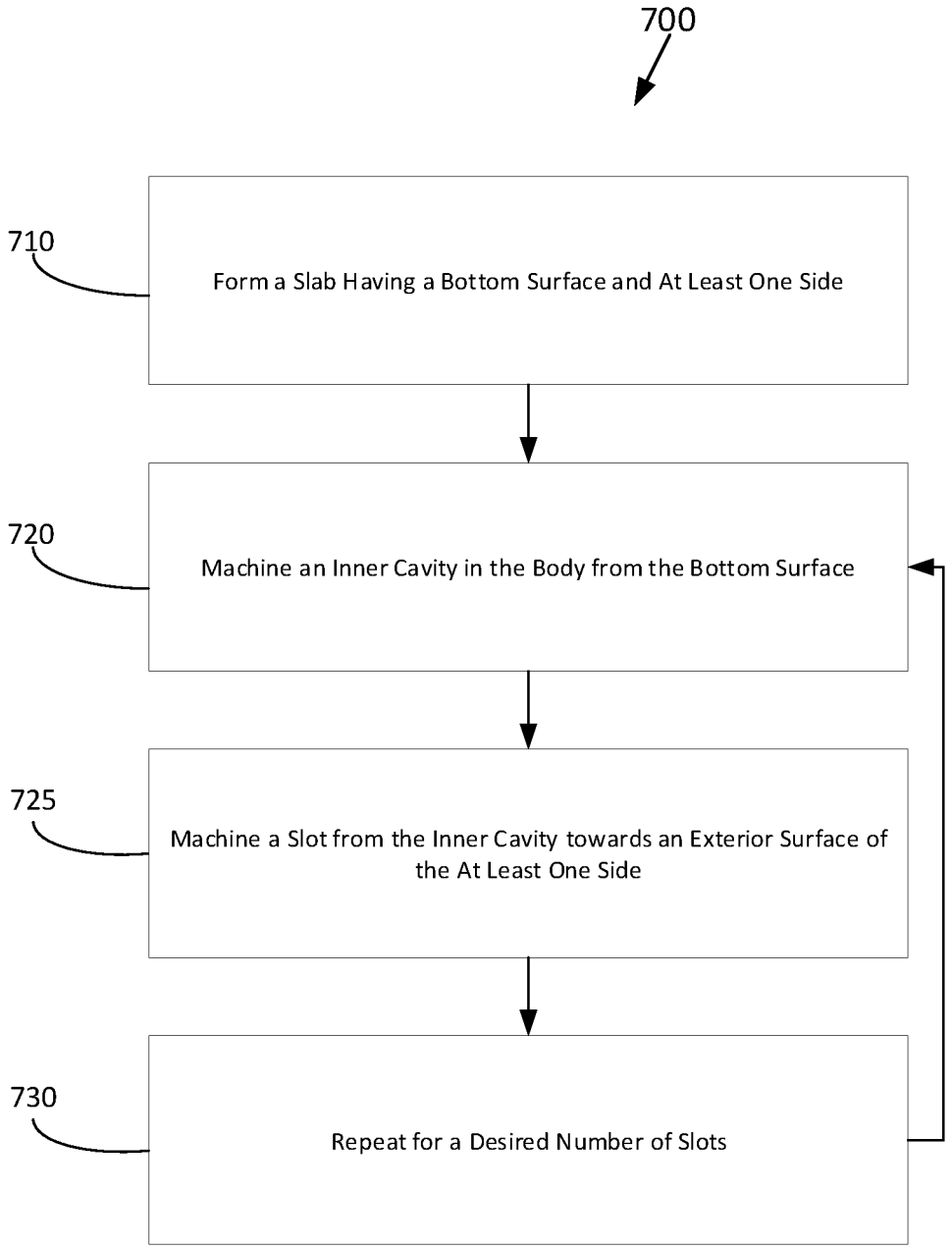
FIG. 7 is a flow chart illustrating an example method of manufacturing the countertop slab of FIG. 2A.

FIG. 7 is a flow chart illustrating an example method 700 of manufacturing a countertop slab, such as the first slab 100, for example. The method 700 may include, at block 710, forming a slab having a body with a bottom surface and at least one side. In some embodiments, a layer of laminate may be applied to the slab.

The method 700 may also include, at block 720, machining, in the body from the bottom surface, an inner cavity with a first width and a depth less than a lateral thickness of the body. The method 200 may further include, at block 725, machining a slot from the inner cavity radially outwards towards an exterior surface of the at least one side. The slot may have the depth of the inner cavity and a second width less than the first width, such that the slot may continue the depth of the inner cavity but be relatively narrower. Furthermore, the length of the machined slot is such that an amount of material is left between the end of the slot and the exterior of the outer portion. This amount of material (e.g., the cover 155) may laterally obscure the slot and prevent the slot from being seen or accessed from the outside of the slab until the cover 155 is removed.

The method 700 may further include, at block 730, repeating the machinings at blocks 720 and 725 until a desired number of slots are machined. For example, as shown in the example embodiment of FIG. 2A, blocks 720 and 725 may be repeated eight times, as there are eight slots 150.

Figure 8:
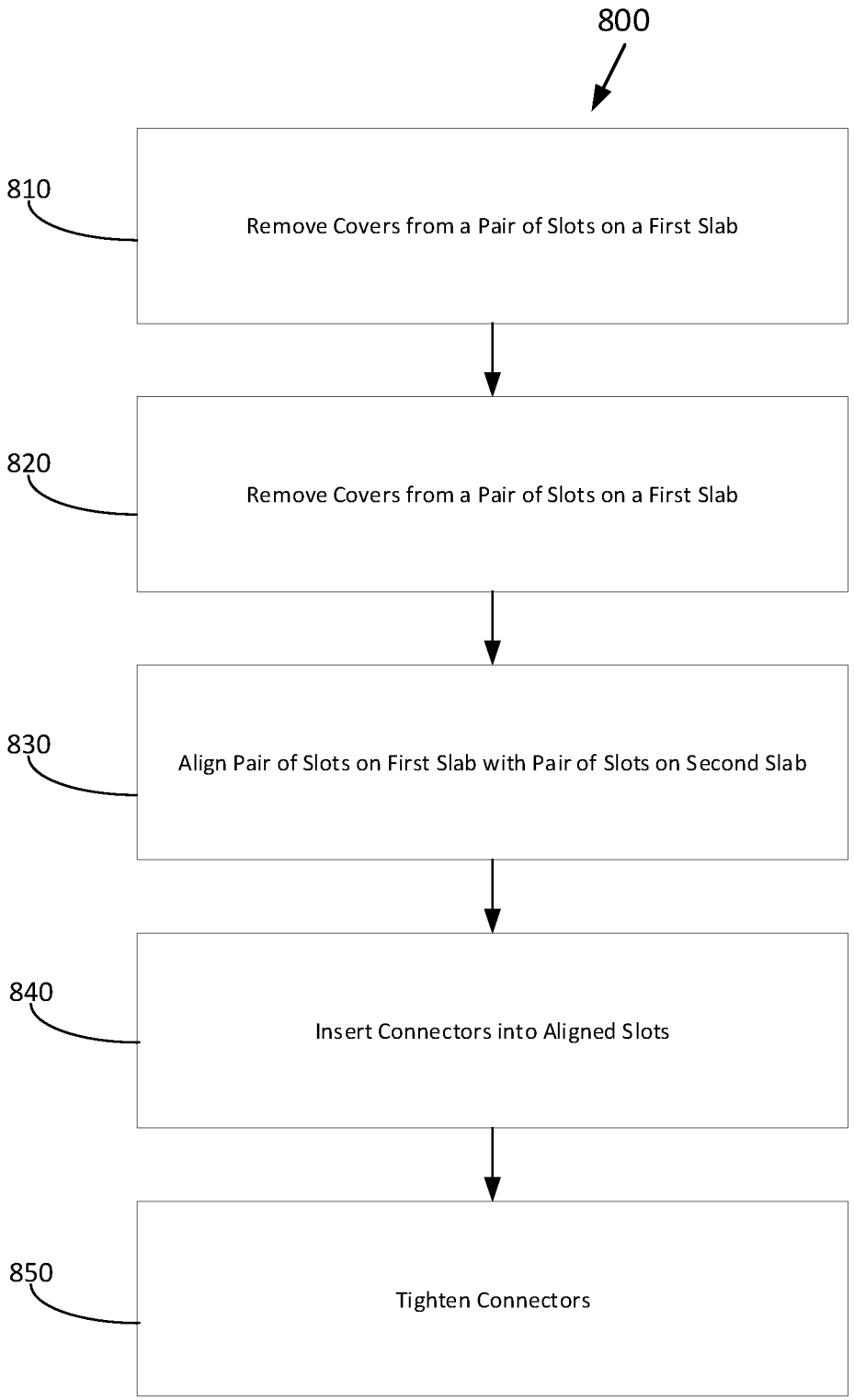
FIG. 8 is a flow chart illustrating an example method of assembly the assembly of FIG. 1.

FIG. 8 is a flow chart illustrating an example method 800 of assembling a countertop assembly, such as the assembly 10, for example. The method 800 may include, at block 810, removing covers from a pair of slots (e.g., slots 150*a* and 150*b*) on a first slab (e.g. first slab 100) and, at block 820, removing covers from a pair of slots (e.g., 250*b* and 250*a*) on a second slab (e.g., second slab 200). In some embodiments, covering caps may be applied to an interior of those slots that have covers that were not removed (e.g., slots 150*c*-150*h*, slots 250*c*-250*h*). The method 800 may also include, at block 830, aligning the exposed pair of slots on the first slab with the exposed pair of slots on the second slab and, at block 840, inserting a connector (e.g., connector 300) into the aligned slots. The method 800 may further include, at block 850, tightening the connectors (e.g., via an allen key) to couple the first slab to the second slab.

In some embodiments of the present disclosure, a countertop system may include a first slab having a first lateral slot that is laterally obscured by a first cover; and a second slab having a second lateral slot that is laterally obscured by a second cover. The first and second covers may be configured to be removed with an application of pressure, and the first slot may align with the second slot to receive a connector to couple the first slab to the second slab.

In some of these embodiments, the first slab may include a first body having a first exterior surface, the second slab may include a second body having a second exterior surface, the first cover may have a first cover exterior surface that is monolithic with the first exterior surface of the first body, and the second cover may have a second cover exterior surface that is monolithic with the second exterior surface of the first body. In some of these embodiments, the first exterior surface and the first cover exterior surface may include a first laminate layer, and the second exterior surface and the second cover exterior surface may include a second laminate layer.

In other of these embodiments, the first slab may be substantially rectangular and may further include a first lateral side, a second lateral side, a third lateral side, and a fourth lateral side. The first slot may include a plurality of slots, and each of the first, second, third, and fourth lateral sides may include at least one of the plurality of slots. In some of these embodiments, each of the first, second, third, and fourth lateral sides may include two of the plurality of slots. In some of these embodiments, a distance between the two of the plurality of slots may be equal for all of the first, second, third, and fourth lateral sides. In some of these embodiments, the second slab may be identical to the first slab, and two of the plurality of slots of the first side of the first slab may be configured to align with two of a second plurality of slots of any of the lateral sides of the second slab.

In other of these embodiments, the first and third lateral sides may be of a first length, the second and fourth lateral sides may be of a second length greater than the first length, and the at least one slot of each of the second and fourth sides may be closer to the first side than to the third side. In some of these embodiments, the at least one slot of each of the second and fourth lateral sides may be within 6 inches of the first side.

In some embodiments, a method of manufacturing a slab for use in a multi-configuration countertop may include forming a slab with a body having a bottom surface and at least one side; machining an inner cavity in the body from the bottom surface, the inner cavity having a first width and a depth less than a lateral thickness of the body; machining a slot from the inner cavity radially outwards towards an exterior surface of the at least one side. The slot may have the depth of the inner cavity and a second width less than the first width. A lateral cover may remain between an end of the slot and the exterior surface of the at least one side.

In some embodiments, forming the slab may include applying a laminate layer over the exterior surface of the body. In some embodiments, the cover may be configured to be removed with an application of pressure.

In some embodiments, the at least one side may include a first lateral side, a second lateral side, a third lateral side, and a fourth lateral side, and machining the slot may further include machining at least one slot on each of the first lateral side, the second lateral side, the third lateral side, and the fourth lateral side. In some of these embodiments, machining the slot may further include machining two slots on each of the first lateral side, the second lateral side, the third lateral side, and the fourth lateral side, and a distance between the two slots may be the same for all of the lateral sides. In some of these embodiments, the slot may be laterally obscured by the cover until the cover is removed.

In some embodiments, a slab for a countertop system may include a body having an exterior surface, and a lateral slot that is laterally obscured by a cover. In some of these embodiments, the cover may be configured to be removed with an application of pressure, and may have a cover exterior surface that is monolithic with the exterior surface of the body.

In some of these embodiments, the slab may be substantially rectangular and further include a first lateral side, a second lateral side, a third lateral side, and a fourth lateral side. The slot may include a plurality of slots, and each of the first, second, third, and fourth sides may include at least one of the plurality of slots.

In some of these embodiments, each of the first, second, third, and fourth lateral sides may include two of the plurality of slots. In some of these embodiments, a distance between the two of the plurality of slots may be equal for all of the first, second, third, and fourth lateral sides. In some of these embodiments, the at least one slot of each of the second and fourth lateral sides is within 6 inches of the first side.

While this disclosure has described certain embodiments, it will be understood that the claims are not intended to be limited to these embodiments except as explicitly recited in the claims. On the contrary, the instant disclosure is intended to cover alternatives, modifications and equivalents, which may be included within the spirit and scope of the disclosure. Furthermore, in the detailed description of the present disclosure, numerous specific details are set forth in order to provide a thorough understanding of the disclosed embodiments. However, it will be obvious to one of ordinary skill in the art that systems and methods consistent with this disclosure may be practiced without these specific details. In other instances, well known methods, procedures, components, and circuits have not been described in detail as not to unnecessarily obscure various aspects of the present disclosure.

What is claimed is:

1. A countertop system comprising:

a first slab having a first bottom surface, a first side surface, and a first lateral slot, wherein the first lateral slot extends into the first bottom surface to a depth less than a thickness of the first slab, and the first lateral slot is laterally obscured on the first side surface by a first cover; and a second slab having a second bottom surface, a second side surface, and a second lateral slot, wherein the second lateral slot extends into the second bottom surface to a depth less than a thickness of the second slab, and the second lateral slot is laterally obscured on the second side surface by a second cover, wherein:

the first and second covers are configured to be removed with an application of pressure, and the first slot aligns with the second slot to receive a connector to couple the first slab to the second slab.

2. The system of claim 1, wherein:

the first slab comprises a first body having a first exterior surface;

the second slab comprises a second body having a second exterior surface;

the first cover has a first cover exterior surface that is monolithic with the first exterior surface of the first body; and the second cover has a second cover exterior surface that is monolithic with the second exterior surface of the second body.

3. The system of claim 2, wherein:

the first exterior surface and the first cover exterior surface comprise a first laminate layer; and the second exterior surface and the second cover exterior surface comprise a second laminate layer.

4. The system of claim 1, wherein the first slab is substantially rectangular and further comprises a first lateral side, a second lateral side, a third lateral side, and a fourth lateral side, wherein the first slot comprises a plurality of slots, and wherein each of the first, second, third, and fourth lateral sides comprises at least one of the plurality of slots.

5. The system of claim 4, wherein each of the first, second, third, and fourth lateral sides comprises two of the plurality of slots.

6. The system of claim 5, wherein a distance between the two of the plurality of slots is equal for all of the first, second, third, and fourth lateral sides.

7. The system of claim 6, wherein the second slab is identical to the first slab, and wherein the two of the plurality of slots of the first side of the first slab are configured to align with two of a second plurality of slots of any of the lateral sides of the second slab.

8. The system of claim 4, wherein:

the first and third lateral sides are of a first length, the second and fourth lateral sides are of a second length greater than the first length, and the at least one slot of each of the second and fourth sides is closer to the first side than to the third side.

9. The system of claim 7, wherein the at least one slot of each of the second and fourth lateral sides is within 6 inches of the first side.

* * * * *